US007849654B2

(12) United States Patent
Ban et al.

(10) Patent No.: US 7,849,654 B2
(45) Date of Patent: Dec. 14, 2010

(54) FLOORING SYSTEM

(75) Inventors: Kazuo Ban, Takatsuki (JP); Tomoyuki Tani, Takatsuki (JP)

(73) Assignee: Alinco Incorporated (JP)

( * ) Notice: Subject to any disclaimer, the term of this patent is extended or adjusted under 35 U.S.C. 154(b) by 611 days.

(21) Appl. No.: 11/949,798

(22) Filed: Dec. 4, 2007

(65) Prior Publication Data

US 2009/0077918 A1 Mar. 26, 2009

(30) Foreign Application Priority Data

Sep. 26, 2007 (JP) ..... 2007-249030

(51) Int. Cl.
*E04B 2/00* (2006.01)

(52) U.S. Cl. ..... 52/582.1; 52/586.1; 52/586.2; 52/582.2

(58) Field of Classification Search ..... 52/597, 52/604, 592.2, 590.2, 587.1, 591.5, 588.1, 52/285.4, 568, 571; 404/35, 36; 446/85, 446/108, 120–124, 128
See application file for complete search history.

(56) References Cited

U.S. PATENT DOCUMENTS

| | | | | | |
|---|---|---|---|---|---|
| 828,930 | A * | 8/1906 | Crampton | 52/587.1 |
| 2,647,287 | A * | 8/1953 | Jones | 52/582.2 |
| 2,765,581 | A * | 10/1956 | Adler | 446/121 |
| 2,842,814 | A * | 7/1958 | Lindgren | 160/113 |
| 3,353,314 | A * | 11/1967 | Melcher | 52/127.9 |
| 4,136,482 | A * | 1/1979 | Fischer | 446/124 |
| 4,299,067 | A * | 11/1981 | Bertschi | 52/127.12 |
| 4,727,697 | A * | 3/1988 | Vaux | 52/177 |
| 5,424,118 | A * | 6/1995 | McLaughlin | 428/314.8 |
| 6,032,427 | A * | 3/2000 | Randjelovic | 52/584.1 |
| 6,089,784 | A * | 7/2000 | Ardern | 404/41 |
| 6,189,283 | B1 * | 2/2001 | Bentley et al. | 52/587.1 |
| 6,357,194 | B1 * | 3/2002 | Jones, Jr. | 52/590.1 |
| 6,668,514 | B2 * | 12/2003 | Skov | 52/782.1 |
| 7,134,805 | B2 * | 11/2006 | Yee | 404/50 |
| 7,461,482 | B2 * | 12/2008 | Cerasi et al. | 52/177 |
| 7,621,091 | B2 * | 11/2009 | Dickey et al. | 52/582.2 |
| 2004/0123546 | A1 * | 7/2004 | Stull et al. | 52/578 |
| 2005/0075035 | A1 * | 4/2005 | Hatting et al. | 446/85 |

FOREIGN PATENT DOCUMENTS

| | | | |
|---|---|---|---|
| JP | 05302337 | A * | 11/1993 |
| JP | 11-152706 | | 6/1999 |

* cited by examiner

*Primary Examiner*—Richard E Chilcot, Jr.
*Assistant Examiner*—Charissa Ahmad
(74) *Attorney, Agent, or Firm*—St. Onge Steward Johnston & Reens LLC

(57) ABSTRACT

Flooring blocks which can be easily joined to each other and removed have a square-shaped main body and have, on the sides of a square-shaped main body, concave portions and convex portions. In the block main body, block main body side pin insertion paths are perforated along the sides on which the concave portions are formed, and in the convex portions, convex portion side pin insertion paths are perforated. In the block main body side pin insertion paths, pin main bodies of lock pins are inserted slidably between joining positions and housed positions, and the block main body side pin insertion path is partially formed into an open groove opened to the block main body surface, and the open groove is provided with a first lateral groove and a second lateral groove, and block main bodies adjacent to each other are joined to each other by sliding the pin main body of the lock pin in a state that the concave portion and the convex portion are engaged with each other.

13 Claims, 15 Drawing Sheets

FIG.7(a-1)
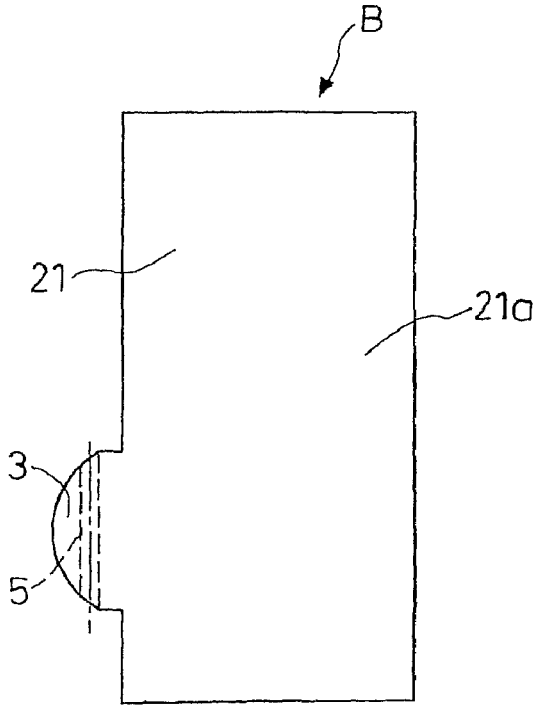
FIG.7(b-1)
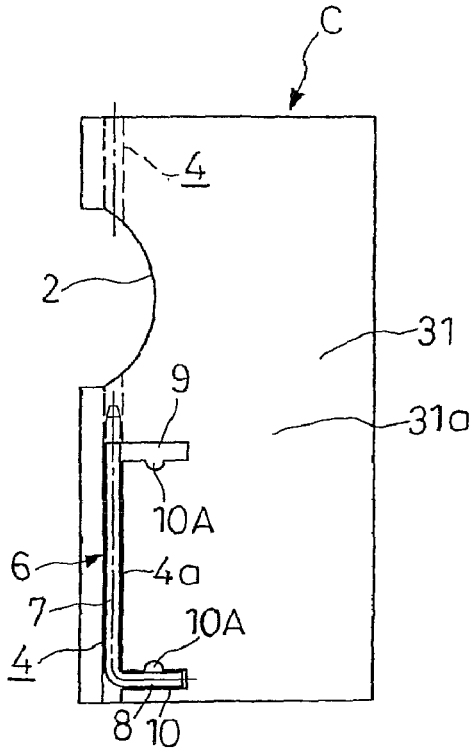
FIG.7(a-2)
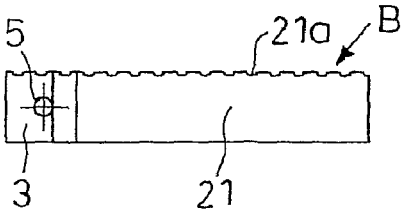
FIG.7(b-2)
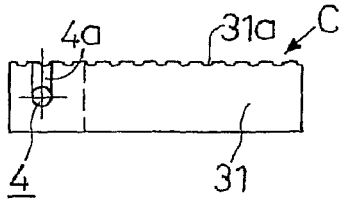

FIG.9(a-1)
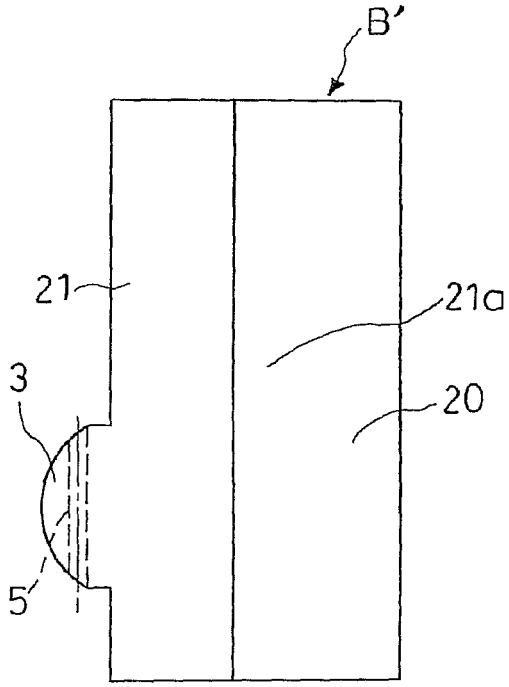
FIG.9(b-1)
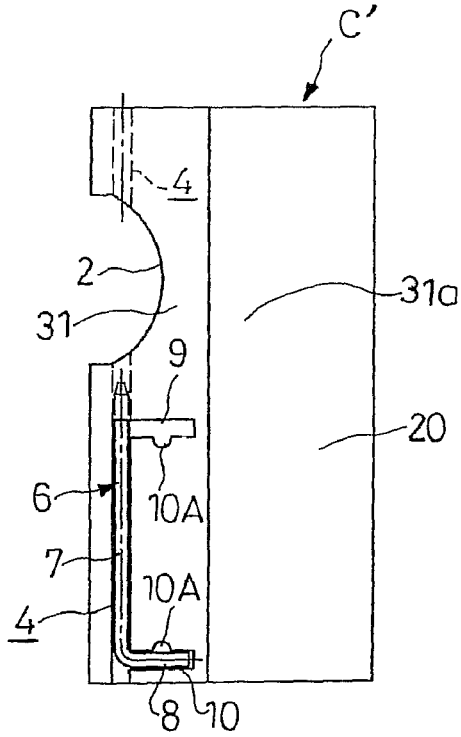
FIG.9(a-2)
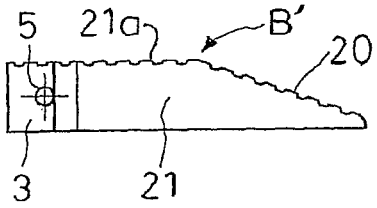
FIG.9(b-2)
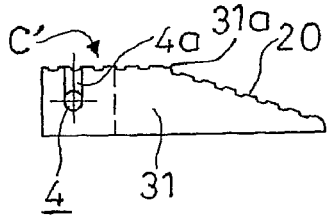

FLOORING SYSTEM

FIELD OF THE INVENTION

The present invention pertains to modular floor coverings.

BACKGROUND OF THE INVENTION

Flooring blocks may be laid on the grounds of construction sites, storage sites for construction materials, car parking areas, parks, unpaved roads and sidewalks, and event sites such as squares, baseball fields, soccer grounds, and athletic track grounds (including in any case, natural grass, and artificial turf).

Conventional flooring blocks, for example, are disclosed in Japanese Published Unexamined Patent Application No. H11-152706. This flooring block is formed by symmetrically uniting two upper and lower plastic block members, and on the respective sides thereof, concave and convex engagement portions are formed, and at least along two facing sides parallel to each other, joint holes are formed, and by inserting a long joint member such as a joint pipe, rope, chain, or rod material through the joint holes, adjacent flooring blocks are joined to each other.

According to the flooring blocks described in this patent document, the flooring block consists of two upper and lower plastic block members joined to each other symmetrically, so that its manufacturing cost is high and assembly takes time. In addition, in the case of this flooring block, a number of flooring blocks are joined by a serial joint pipe or the like, and after the flooring blocks are joined, to replace a broken one, the serial joint pipe or the like which joins many flooring blocks must be pulled out and the flooring blocks must be all separated, so that the flooring block replacement is very troublesome.

SUMMARY OF THE INVENTION

In consideration of the above-described problem, an object of the invention is to provide flooring blocks which have a simple structure and can be manufactured at a low cost, and are structured so that the flooring blocks are easily joined to each other and when one of many flooring blocks joined to each other is broken and needs replacement, only the broken one can be easily removed from other adjacent flooring blocks and replaced with a new one.

In order to achieve the above-described object, according to a flooring block A of the present invention, concave portions 2 and convex portions 3 which make convex-concave engagement with each other are formed on the respective sides of a block main body 1 in a square shape, and in the block main body 1, along the sides on which the concave portions 2 are formed, block main body side pin insertion paths 4 across the concave portions 2 are perforated, and in the respective convex portions 3, convex portion side pin insertion paths 5 which communicate coaxially with the block main body side pin insertion paths 4 of other block main bodies 1 in a state that the convex portions 3 engage with the concave portions 2 of other block main bodies 1 are perforated, and in the block main body side pin insertion paths 4, pin main bodies 7 of lock pins 6 including the pin main bodies 7 and handle portions 8 projecting sideways are inserted rotatably and slidably from joining positions across the concave portions 2 to housed positions withdrawn from the concave portions 2, and the block main body side pin insertion paths 4 are partially formed into open grooves 4*a* opened to the block main body surface 1*a*, and the open grooves 4*a* are provided with first lateral grooves 9 in which the handle portions 8 are sunk when the pin main bodies 7 are at the joining positions and second lateral grooves 10 in which the handle portions 8 are sunk when the pin main bodies 7 are at the housed positions, and by sliding the pin main body 7 of the lock pin 6 to the joining position in a state that the concave portion 2 and the convex portion 3 are engaged with each other, adjacent block main bodies 1 and 1 are joined to each other.

According to the present invention, to continuously join the flooring blocks A forward, rearward, leftward, and rightward, the concave portion 2 and the convex portion 3 of block main bodies 1 and 1 of the flooring blocks A and A adjacent in the front and rear direction are engaged with each other, the handle portion 8 of the lock pin 6 is pulled up from the second lateral groove 10, and the pin main body 7 is slid from the housed position to the joining position by this handle portion 8, whereby the concave portion 2 and the convex portion 3 engaged with each other are joined to each other, and to join the flooring blocks A and A adjacent left and right, in the same manner, the concave portion 2 and the convex portion 3 of the block main bodies 1 and 1 are engaged with each other, the pin main body 7 of the lock pin 6 is slid from the housed position to the joining position, whereby the concave portion 2 and the convex portion 3 are joined to each other, so that the flooring blocks A can be easily joined to each other, and the handle portion 8 of the lock pin 6 is sunk in the first lateral groove 9 and does not project from the surface of the block main body 1*a*.

After laying the flooring blocks A, when a part of the flooring blocks A is broken and needs replacement, the handle portions 8 of the respective lock pins 6 attached to the flooring block A that need replacement are pulled up from the first lateral grooves 9, and by the handle portions 8, the pin main bodies 7 are slid from the joining positions to the housed positions, whereby this flooring block A can be separated from other adjacent flooring blocks A, so that only the flooring block A that need replacement can be easily replaced with a new one. This flooring block A is simple in structure, so that its manufacturing cost is low.

Other objects will be made clear from the following description.

BRIEF DESCRIPTION OF THE DRAWINGS

For a complete understanding of the above and other features of the invention, reference shall be made to the following detailed description of the preferred embodiments of the invention and to the accompanying drawings, wherein:

FIG. 7(*a*-1) is a plan view of a peripheral flooring block B, FIG. 7(*a*-2) is a front view thereof, FIG. 7(*b*-1) is a plan view of another peripheral flooring block C, and FIG. 7(*b*-2) is a front view thereof;

FIG. 9(*a*-1) is a plan view showing a sloped peripheral flooring block B', FIG. 9(*a*-2) is a front view thereof, FIG. 9(*b*-1) is a plan view of another sloped peripheral flooring block C', and FIG. 9(*b*-2) is a front view thereof;

DETAILED DESCRIPTION OF THE PREFERRED EMBODIMENTS OF THE INVENTION

Figure 1A:
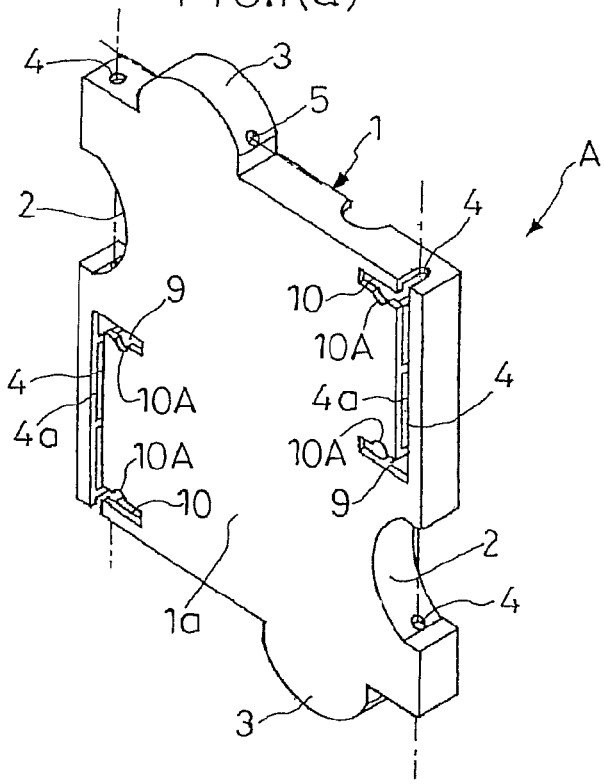
FIG. 1(*a*) is a perspective view of a flooring block A of the present invention from the surface side, and FIG. 1(*b*) is a perspective view of the same flooring block A from the back side.
Figure 1B:
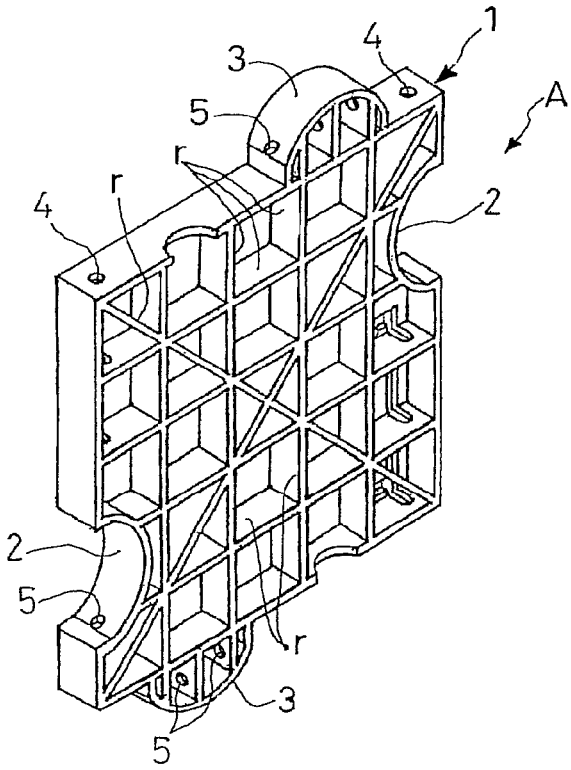

Hereinafter, preferred embodiments of the invention will be described with reference to the drawings. FIG. 1(*a*) is a perspective view of a flooring block A of the present invention from the surface side, and FIG. 1(*b*) is a perspective view of the same flooring block A from the back side, FIG. 2(*a*) is a plan view of the same flooring block A, FIG. 2(*b*) is a side view of the same flooring block A from the arrow P of FIG. 2(*a*), and FIG. 2(*c*) is a side view of the flooring block A from the arrow Q of FIG. 2(*a*), FIG. 3(*a*) is a bottom view of the same flooring block A, and FIG. 3(*b*) is a plan view of a lock pin. FIG. 4(*a*) is a plan view showing a used state of many flooring blocks A joined to each other, and FIG. 4(*b*) is an enlarged view of a portion indicated by the arrow T of FIG. 4(*a*).

Figure 2C:
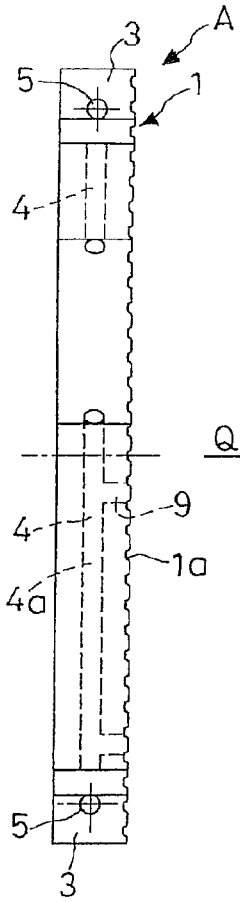
FIG. 2(*a*) is a plan view of the same flooring block A, FIG. 2(*b*) is a side view of the same flooring block A from the arrow P of FIG. 2(*a*), and FIG. 2(*c*) is a side view of the flooring block A from the arrow Q.
Figure 2A:
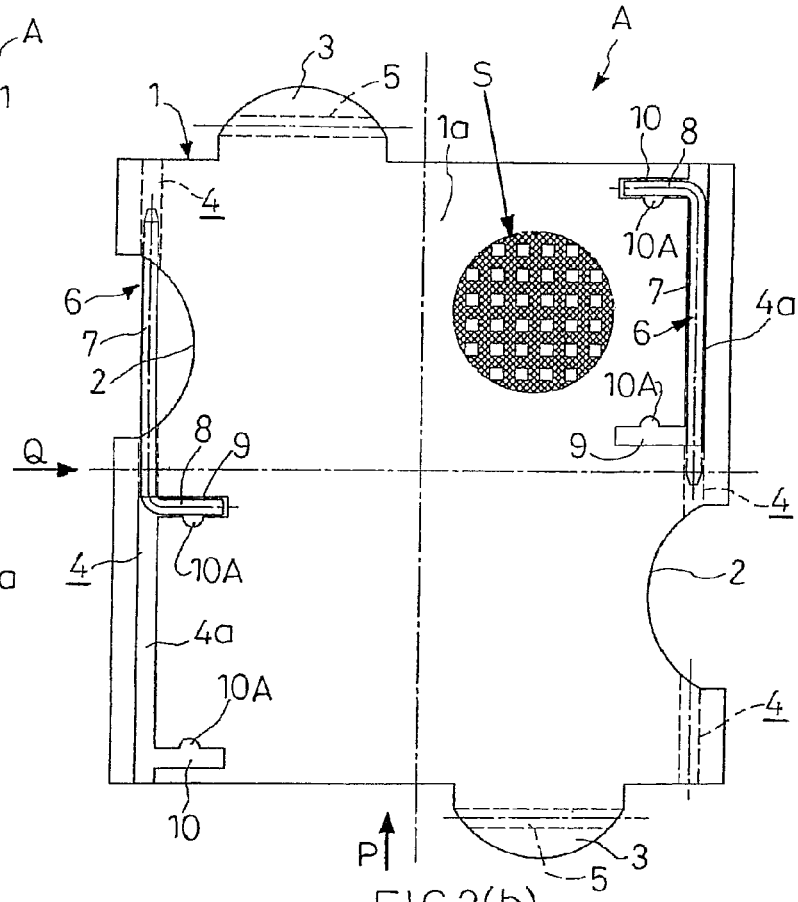
Figure 2B:
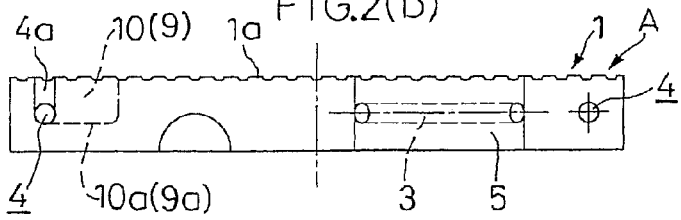

This flooring block A is formed of a plastic block main body 1 in a square shape having sides with substantially equal lengths, and on the respective sides of the block main body 1 in the square shape, concave portions 2 and convex portions 3 which make convex-concave engagement with each other are formed alternately. Referring to FIG. 2(*a*), on the left half of the upper side of the square-shaped block main body 1, a convex portion 3 is formed, on the right half of the lower side, a convex portion 3 is formed, and on the lower half of the right side of the left and right sides, a concave portion 2 is formed, and on the upper half of the left side, a concave portion 2 is formed. A part of the surface 1*a* of the block main body 1 is indicated by the arrow S of FIG. 2(*a*), and is subjected to antiskid treatment so as to have irregularity as shown in FIG. 2(*b*) and FIG. 2(*c*), and on the back surface, ribs r are formed in a longitudinal, lateral, and diagonal grid pattern as shown in FIG. 1(*b*) and FIG. 3.

In the block main body 1, along the sides (right side and left side when referring to FIG. 2(*a*)) on which the concave portions 2 are formed, block main body side pin insertion paths 4 across the concave portions 2 are perforated parallel to each other across the entire sides, and in the respective convex portions 3, convex portion side pin insertion paths 5 which communicate coaxially with the block main body side pin insertion paths 4 in a state that the convex portions 3 engage with the concave portions 2 of other block main bodies 1 are perforated in directions orthogonal to the block main body side pin insertion paths 4.

Figure 3A:
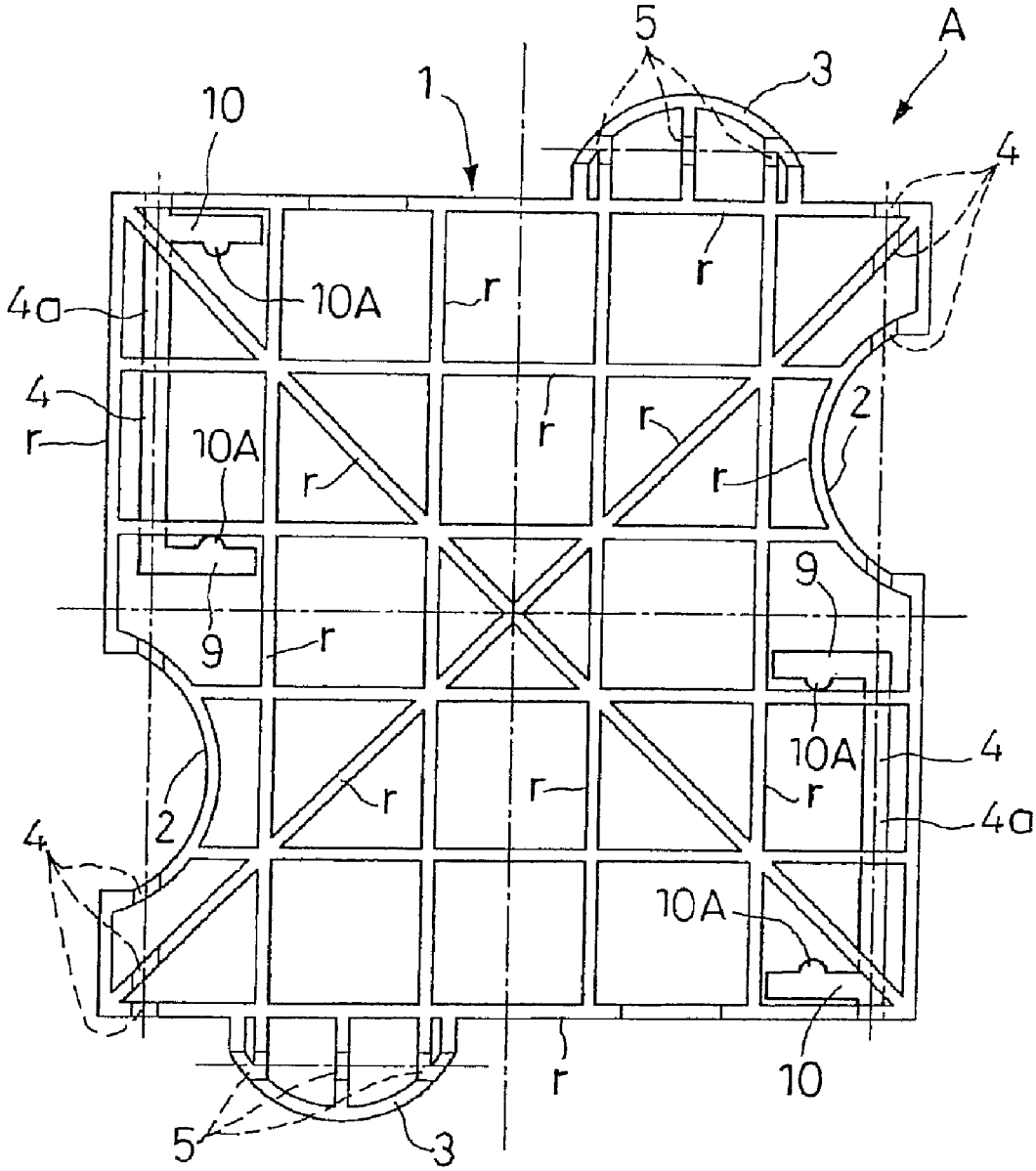
FIG. 3(*a*) is a bottom view of the same flooring block A, and FIG. 3(*b*) is a plan view of a lock pin.
Figure 3B:
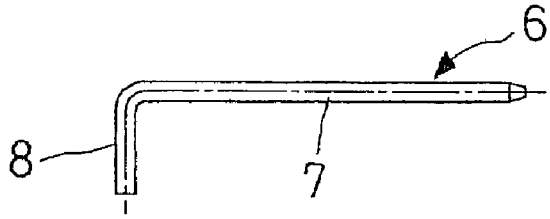
Figure 4A:
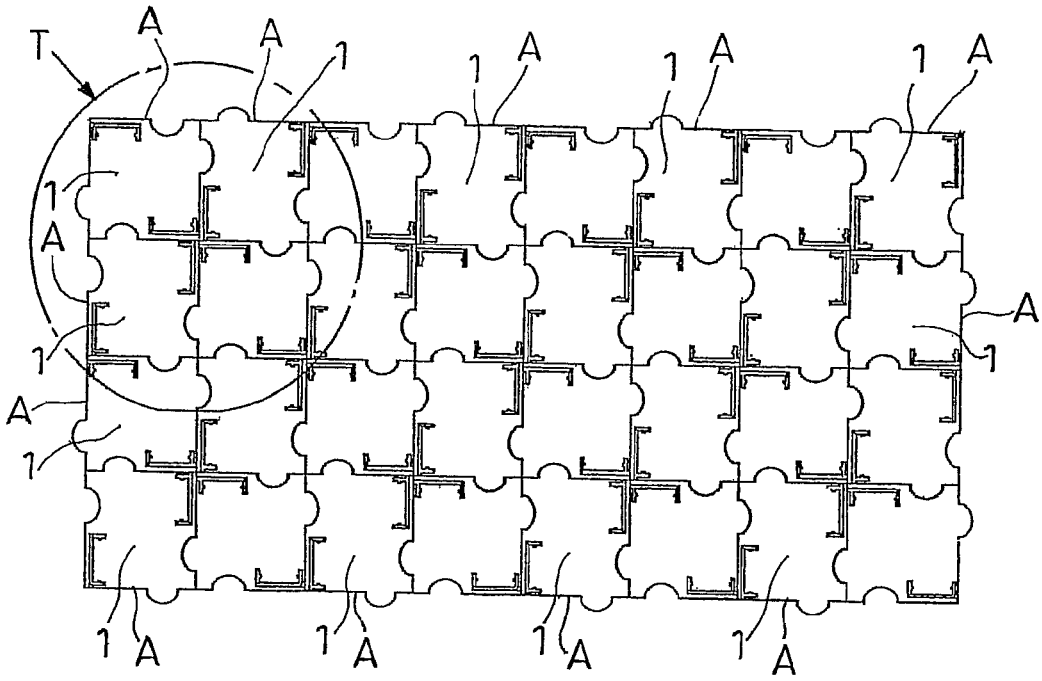
FIG. 4(*a*) is a plan view showing a used state of the same flooring blocks A, and FIG. 4(*b*) is an enlarged view of a portion indicated by the arrow T of FIG. 4(*a*)
Figure 4B:
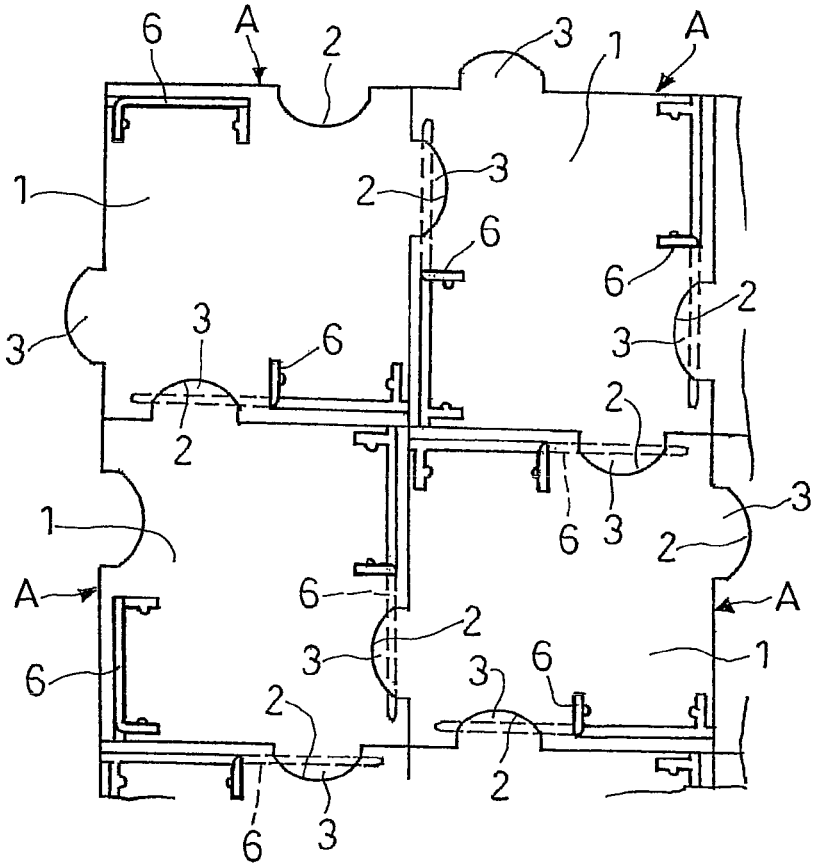

In the block main body side pin insertion path 4, a pin main body 7 of a lock pin 6 formed into an L shape as shown in FIG. 3(*b*) including the pin main body 7 and a handle portion 8 projecting sideways perpendicularly from one end of the pin main body is inserted rotatably and slidably between a joining position across the concave portion 2 as shown in the left side of FIG. 2(*a*) and a housed position withdrawn from the concave portion 2 as shown in the right side of FIG. 2(*a*).

The block main body side pin insertion path 4 is, as seen in FIG. 1(*a*) and FIG. 2(*a*), partially formed into an open groove 4*a* opened to the surface 1*a* of the block main body 1, and from this open groove 4*a*, a first lateral groove 9 in which the handle portion 8 is sunk when the pin main body 7 is at the joining position and a second lateral groove 10 in which the handle portion 8 is sunk when the pin main body 7 is at the housed position are formed in a branched manner so as to be orthogonal to the open groove 4*a*. The bottom surfaces 9*a* and 10*a* of the first lateral groove 9 and the second lateral groove 10 are parallel to the surface 1*a* of the block main body 1 as shown by the dashed lines in FIG. 2(*b*).

As seen in FIG. 1(*a*) and FIG. 2(*a*), in the first lateral groove 9 and the second lateral groove 10, on the inner wall faces of these, insertion portions 10A into which an operator's finger or a rod-like body such as a tool is inserted to pull-up the handle portion 8 of the lock pin 6 sunk in the lateral groove 9 or 10 are recessed.

Next, to lay the flooring blocks A constructed as described above continuously forward, rearward, leftward, and rightward as shown in FIG. 4 at a predetermined site, the concave portion 2 and the convex portion 3 facing each other of the block main bodies 1 and 1 of the flooring blocks A and A adjacent to each other in the front and rear direction are engaged with each other, and by sliding the pin main body 7 of the lock pin 6 from the housed position to the joining position, the engaged concave portion 2 and convex portion 3 are joined to each other, and the concave portion 2 and the convex portion 3 facing each other of the block main bodies 1 and 1 of the flooring blocks A and A adjacent to each other in the left and right direction are engaged with each other, and by sliding the pin main body 7 of the lock pin 6 from the housed position to the joining position, the engaged concave portion 2 and convex portion 3 are joined. The state that a large number of flooring blocks A are thus joined continuously in the front and rear direction and the left and right direction is shown in FIG. 4(*a*), and FIG. 4(*b*) is an enlarged view of the portion indicated by the arrow T of FIG. 4(*a*).

A method for joining the concave portion 2 and the convex portion 3 engaged with each other will be described in greater detail with reference to FIG. 2 also. In the state that the pin main body 7 of the lock pin 6 is withdrawn to the housed position (the state shown in the right side of FIG. 2(*a*)), the concave portion 2 and the convex portion 3 facing each other of the block main bodies 1 and 1 of the flooring blocks A and A adjacent to each other in the front and rear direction or the left and right direction are engaged with each other, and then the handle portion 8 of the lock pin 6 sunk in the second lateral groove 10 is pulled up and made to move out from the second lateral groove 10, and thereafter, by this handle portion 8, the pin main body 7 is slid from the housed position to the joining position along the open groove 4*a* of the block main body side pin insertion path 4 (the state shown in the left side of FIG. 2(*a*)), whereby the concave portion 2 and the convex portion 3 are joined to each other. After this joining, the handle portion 8 of the lock pin 6 is pushed and sunk into the first lateral groove 9, whereby the lock pin 6 is locked at the joining position. At this tine, it is preferable that the handle portion 8 fallen into the first lateral groove 9 slightly tightly engages with the peripheral walls of the first lateral groove 9, and therefore, as described later, to pull up the handle portion, a screwdriver or the like is used.

To pull up the handle portion 8 of the lock pin 6 from the second lateral groove 10, an operator's finger is inserted in the insertion portion 11 provided in the second lateral groove 10 or a screwdriver or the like is inserted to lift the handle portion, whereby the handle portion 8 can be easily pulled up.

After many flooring blocks A are laid on a predetermined location as described above, when a part of the flooring blocks A is broken and needs replacement, the handle portions 8 of the lock pins 6 attached to the flooring block A that need replacement are pulled up from the first lateral grooves 9, and by the handle portions 8, the pin main bodies 7 are slid from the joining positions to the housed positions, whereby this flooring block A can be separated from other adjacent flooring blocks A, so that only the flooring block A that has broken and needs replacement can be removed and replaced with a new one.

The flooring blocks A of the present invention can be easily laid on the grounds of construction sites, storage sites for construction materials, car parking areas, parks, unpaved roads and sidewalks as well as the grounds of event sites such as squares, baseball fields, soccer grounds, and athletic tracks (including in any case, natural grass, and artificial turf).

Figure 5A:
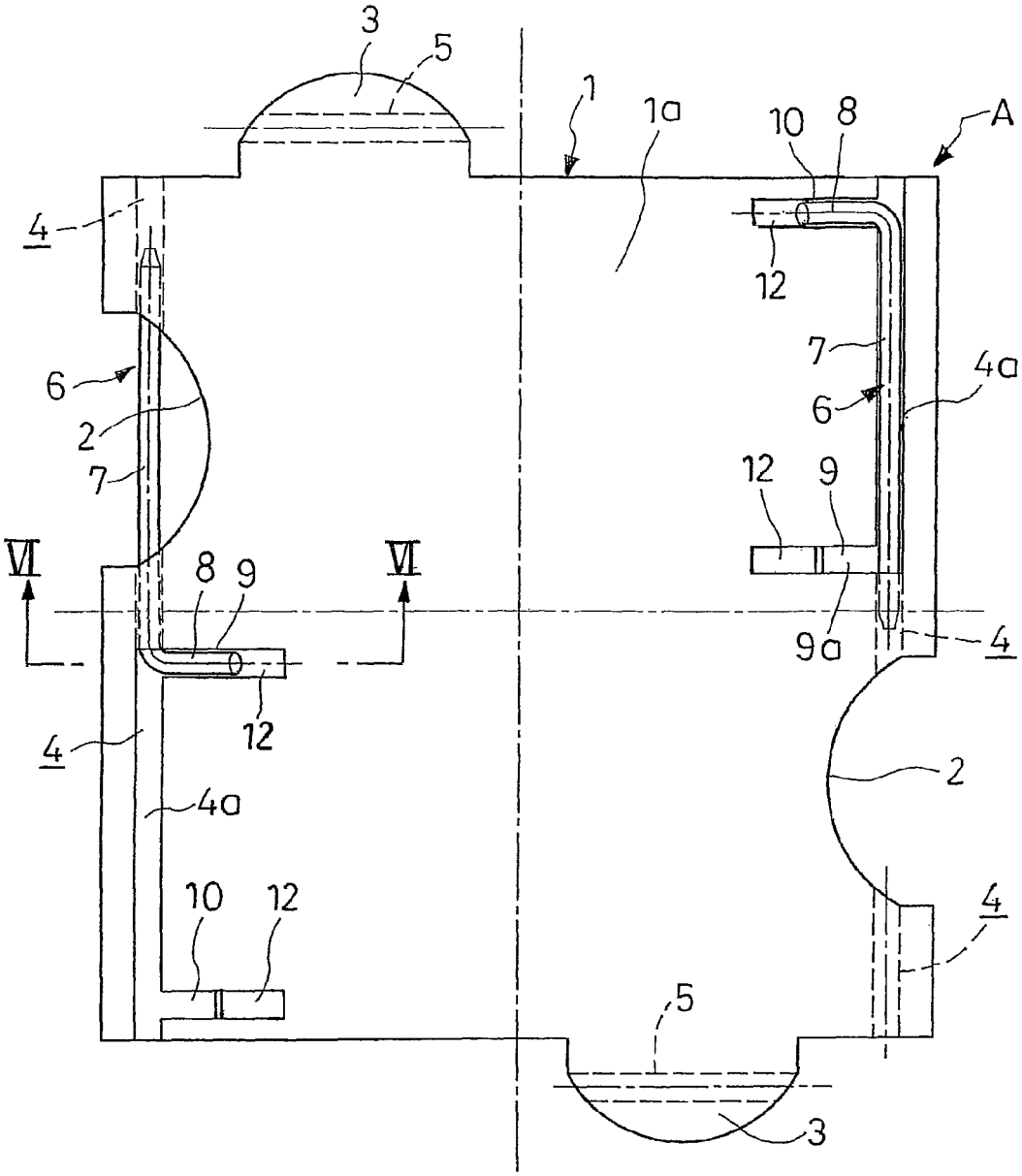
FIG. 5(*a*) is a plan view of a flooring block A of another embodiment, and FIG. 5(*b*) is a side view.
Figure 5B:
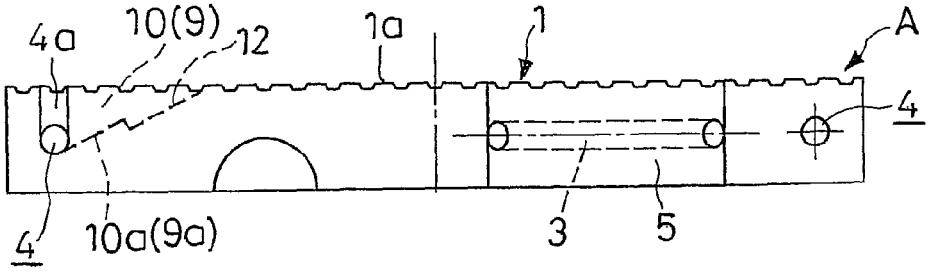
Figure 6:
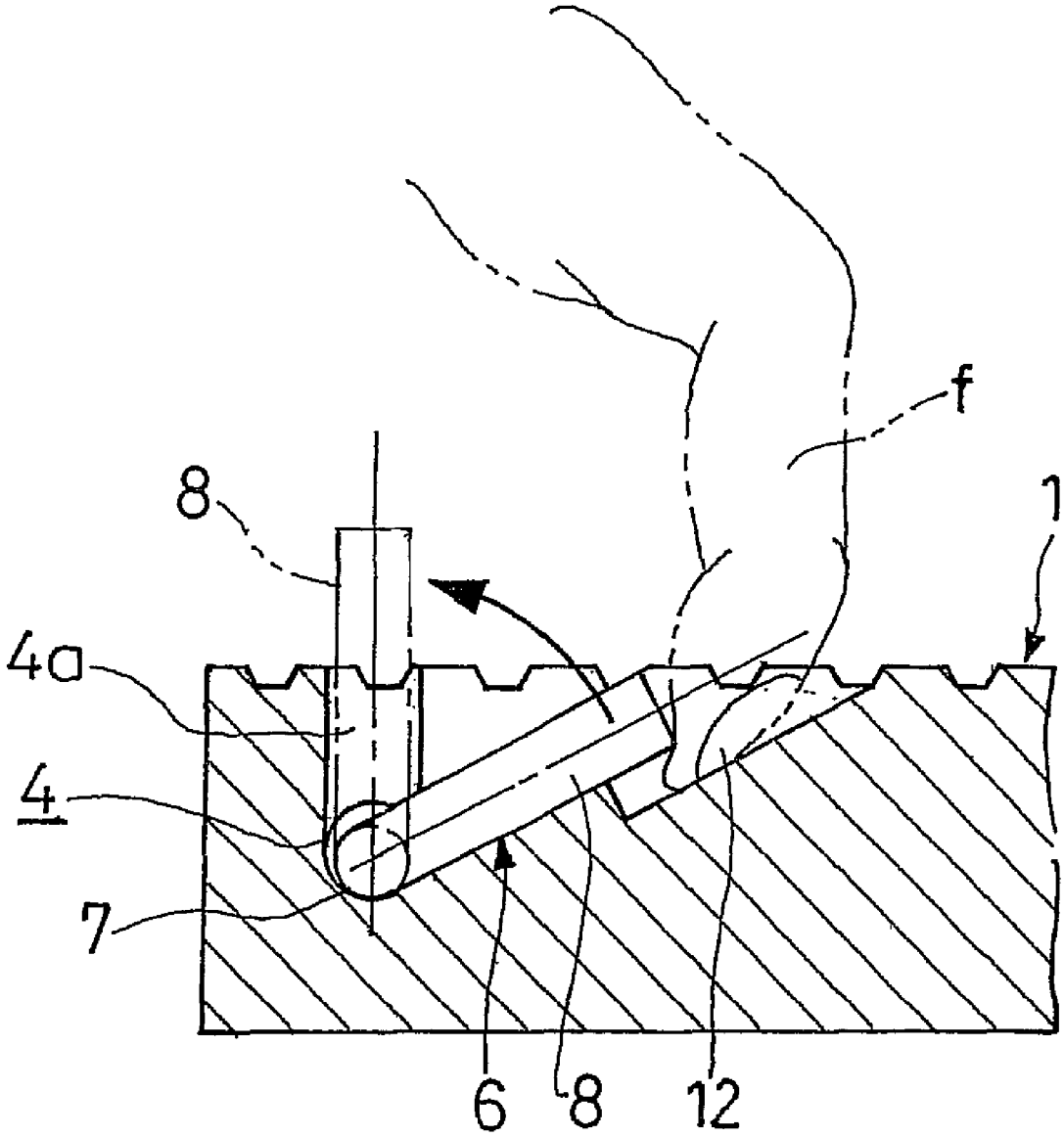
FIG. 6 is an enlarged sectional view along the VI-VI line of FIG. 5(*a*)

In the embodiment shown in FIG. 1 through FIG. 4, the inner wall faces 9*a* and 10*a* of the first lateral groove 9 and the second lateral groove 10 of the block main body side pin insertion path 4 are formed into flat surfaces parallel to the surface 1*a* of the block main body 1, and on the inner wall faces of the grooves 9 and 10, insertion portions 10A into which an operator's finger or a rod-like body is inserted to pull-up the handle portion 8 of the lock pin 6 are recessed, however, in the embodiment of FIG. 5 and FIG. 6, the bottom surfaces 9*a* and 10*a* of the first lateral groove 9 and the second lateral groove 10 are formed into inclined surfaces upslope toward the surface 1*a* of the block main body 1 from the bottom of the open groove 4*a*, whereby, to pull-up the handle portion 8 of the lock pin 6 sunk in the lateral groove 9 or 10, by inserting an operator's finger f or a rod-like body such as a screwdriver into the upstream end side of the inclined bottom surface 9*a* or 10*a* of the lateral groove 9 or 10, the handle portion 8 of the lock pin 6 can be easily pulled up. The inclination angle of the inclined bottom surfaces 9*a* and 1*a* with respect to the horizontal plane is preferably 30 to 45 degrees.

In this case, by forming insertion portions 12 into which an operator's finger or a rod-like body is inserted by forming the upstream end sides of the inclined bottom surfaces 9*a* and 10*a* of the first lateral groove 9 and the second lateral groove 10 to be one step deeper as seen in FIG. 6, the tip end of the handle portion 8 of the lock pin 6 sunk in each lateral groove 9 or 10 can be easily caught by the finger f, or the rod-like body can be easily hooked on the tip end of the handle portion 8, so that the handle portion 8 can be more easily pulled up.

Figure 8:
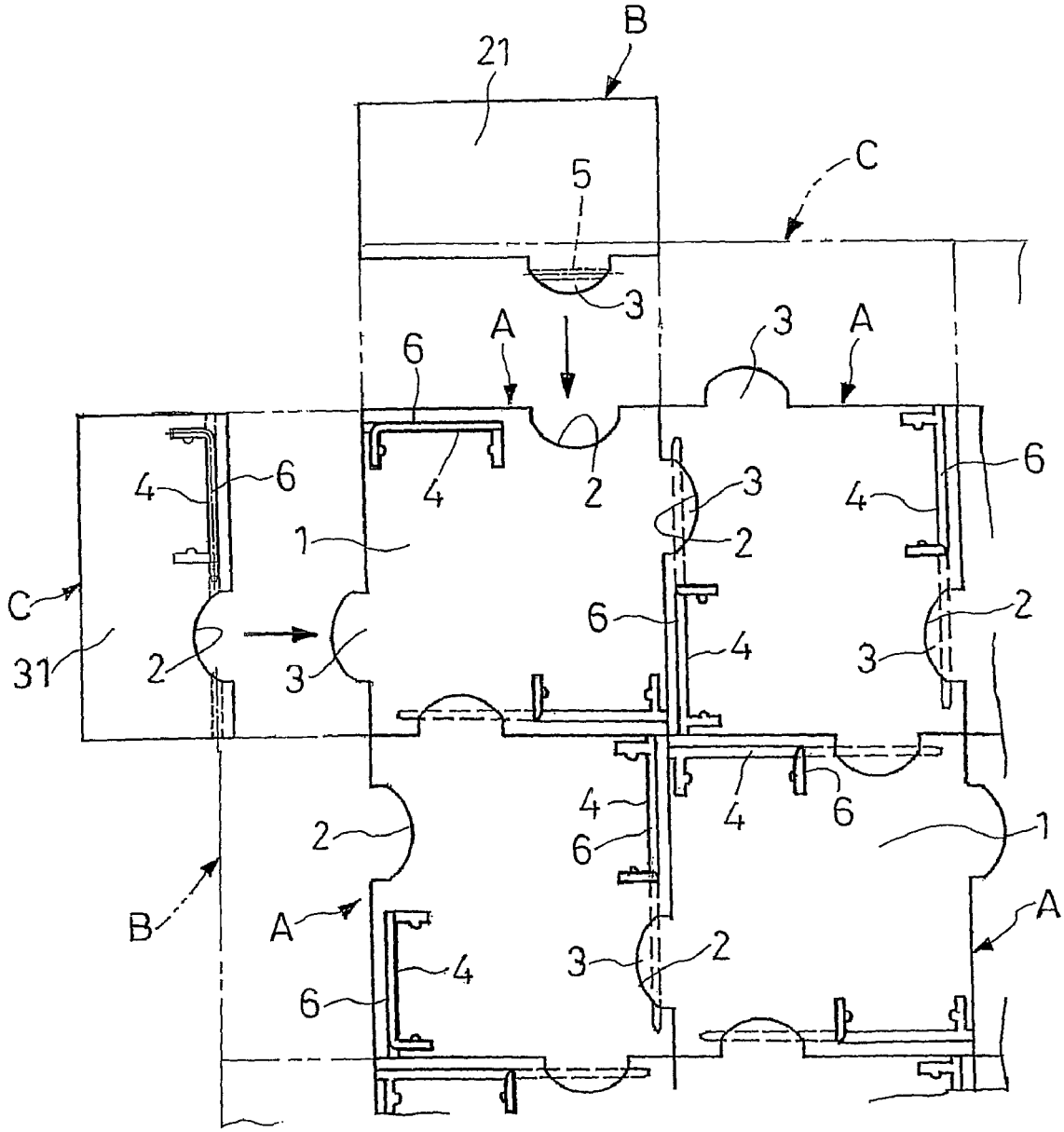
FIG. 8 is a plan view showing a method for using the peripheral flooring block B.

FIG. 7 show peripheral flooring blocks B and C to be joined to the flooring blocks A, positioned on the peripheral portions of the flooring blocks joined structure shown in FIG. 4 laid by joining many flooring blocks A in the front and rear and the left and right directions, and FIG. 8 shows usage of the peripheral flooring blocks B and C. That is, the flooring block A has the concave portions 2 and the convex portions 3 on the respective sides of the square shape, so that as seen in FIG. 4(*a*) and FIG. 4(*b*), to the peripheries of the flooring blocks joined structure, the concave and convex portions 2 and 3 of the flooring blocks A are exposed, and this detracts from the external appearance and external look, and has a problem in that the toe or the like of a shoe is caught on and breaks the concave and convex portions. Therefore, peripheral flooring blocks B and C different from the flooring block A are provided so as to prevent the concave and convex portions 2 and 3 from being exposed to the peripheries of the flooring blocks joined structure. The peripheral flooring blocks B and C are formed into rectangular shapes dividing the square flooring block A into two, and on one longer side of the rectangular shape, the concave portion 2 or the convex portion 3 is formed.

The peripheral flooring block B has, as shown in FIG. 7(*a*-1) and FIG. 7(*a*-2), a convex portion 3 formed on one longer side of a rectangular block main body 21 in a size dividing the square flooring block A into two, and in this convex portion 3, a pin insertion path 5 which communicates coaxially with the block main body side pin insertion path 4 of the flooring block A in a state that this convex portion 2 engages with the concave portion 2 of the flooring block A is perforated. The reference numeral 21*a* denotes the surface of the block main body 21. The peripheral flooring block C has, as shown in FIG. 7(*b*-1) and FIG. 7(*b*-2), a concave portion 2 on one longer side of a rectangular block main body 31 with the same size as the peripheral flooring block B, and a pin insertion path 4 across the concave portion 2 parallel to said one longer side is perforated, and in this pin insertion path 4, the pin main body 7 of the lock pin 6 is inserted rotatably and slidably between a joining position across the concave portion 2 and a housed position withdrawn from the concave portion 2, and this pin insertion path 4 is partially formed into an open groove 4*a* opened to the block main body surface 31*a*, and in this open groove 4*a*, a first lateral groove 9 in which the handle portion 8 is sunk when the pin main body 7 is at the joining position and a second lateral groove 10 in which the handle portion 8 is sunk when the pin main body 7 is at the housed position are provided.

The concave portion 2, the convex portion 3, the pin insertion paths 4 and 5, the open groove 4*a*, and the lock pin 6 of the peripheral flooring blocks B and C are completely the same in construction as those of the flooring block A, so that the same member is attached with the same reference numeral and detailed description thereof is omitted. To the first lateral groove 9 and the second lateral groove 10 of the peripheral flooring block C, the construction of the inclined surfaces 9*a* and 10*a* of FIG. 6 is also applied. In this embodiment, the peripheral flooring blocks B and C are in rectangular shapes with a size dividing the square flooring block A into two, however, it is also allowed that they are in square shapes with the same size as that of the square flooring block A.

To use the peripheral flooring blocks B and C, first, the convex portion 3 of the peripheral flooring block B is engaged with the concave portion 2 of one flooring block A positioned on the peripheral portion of the flooring blocks joined structure shown in FIG. 8, and thereafter, according to completely the same method as the joining method of the flooring blocks A described above, by sliding the pin main body 7 of the lock pin 6 from the housed position to the joining position, the block main body 21 of the peripheral flooring block B can be joined to the block main body 1 of the flooring block A. Similarly, in the state that the concave portion 2 of the peripheral flooring block C is engaged with the convex portion 3 of the flooring block A positioned on the peripheral portion of the flooring blocks joined structure of FIG. 8, the pin main body 7 of the lock pin 6 is slid from the housed position to the joining position, whereby the block main body 31 of this peripheral flooring block C can be joined to the block main body 1 of the flooring block A.

FIG. 9 illustrate sloped peripheral flooring blocks B' and C' obtained by forming slopes 20 on the outer end sides of the block main body surfaces 21*a* and 31*a* of the block main bodies 21 and 31 of the peripheral flooring blocks B and C, and FIG. 9(*a*-1) is a plan view of the sloped peripheral flooring block B' obtained by forming a slope 20 in a region opposite to the convex portion 3 of the block main body surface 21*a* of the peripheral flooring block B, and FIG. 9(*a*-2) is a front view thereof. FIG. 9(*b*-1) is a plan view of the sloped peripheral flooring block C' obtained by forming a slope 20 in a region opposite to the concave portion 2 of the block main body surface 31*a* of the peripheral flooring block C, and FIG. 9(*b*-2) is a front view thereof. The constructions except for the slopes 20 are the same as those of the peripheral flooring blocks B and C of FIG. 7. For example, when the flooring blocks A and the peripheral flooring blocks B and C are laid on natural or artificial grass of a baseball field to form a flooring blocks joined structure for an event site and people step on the flooring blocks joined structure, shoes may caught by the level difference on the peripheral portions, so that the slopes 20 are provided for avoiding this risk.

Figure 10C:
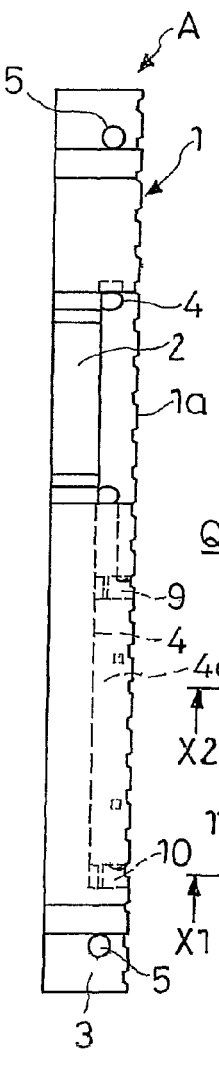
FIG. 10(*a*) is a plan view of a flooring block A showing another embodiment of the invention, FIG. 10(*b*) is a side view of the same flooring block A from the arrow P of FIG. 10(*a*), and FIG. 10(*c*) is a side view from the arrow Q of FIG. 10(*a*)
Figure 10A:
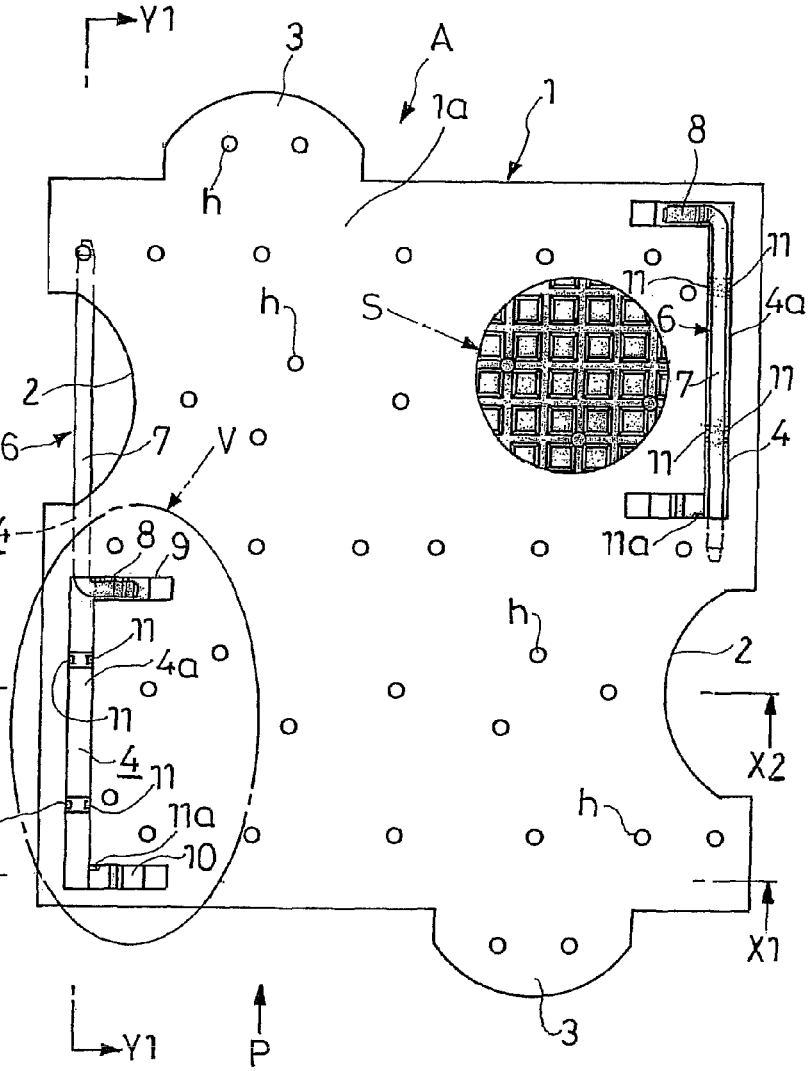
Figure 10B:
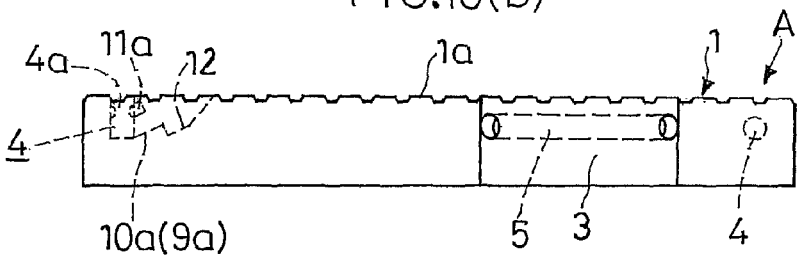
Figure 11A:
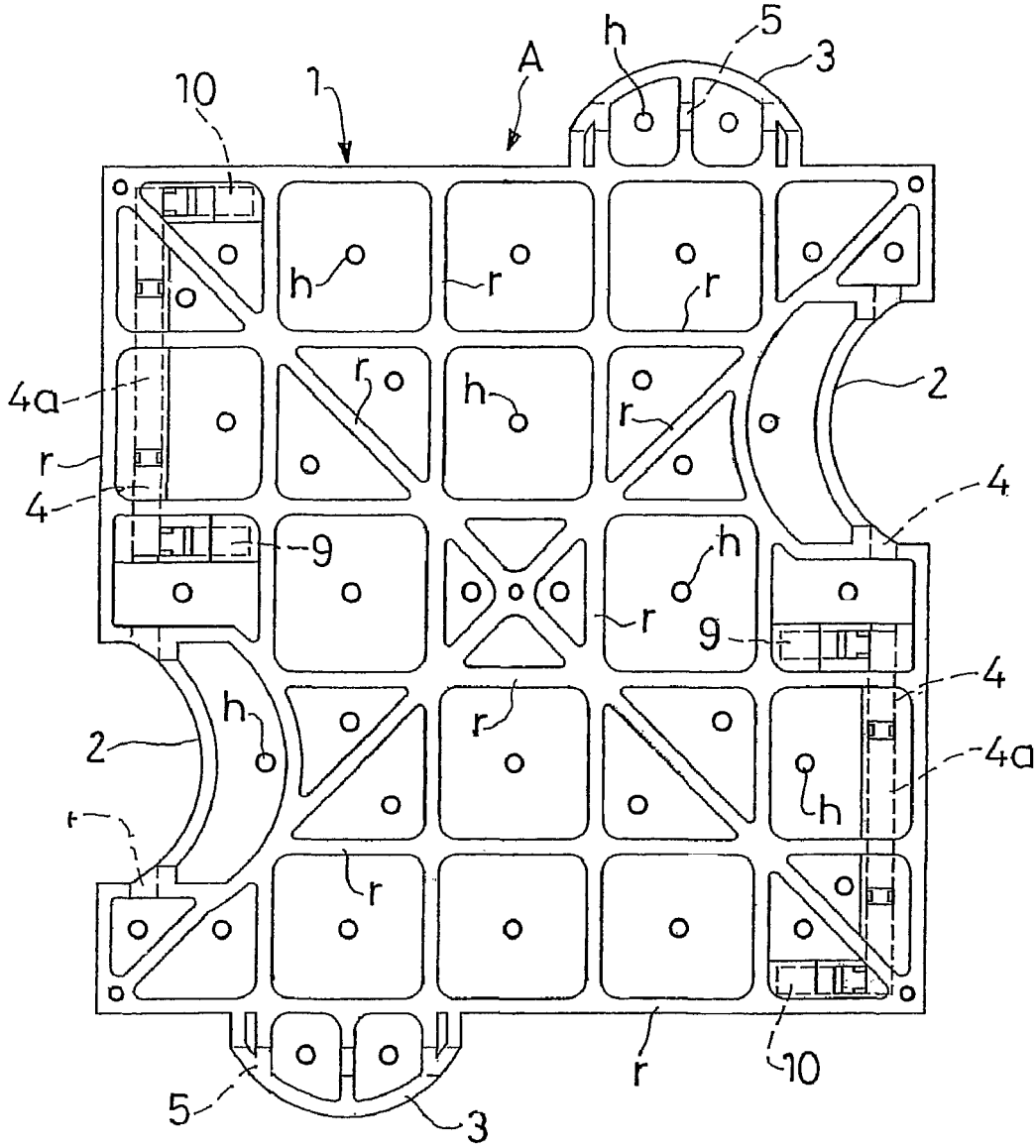
FIG. 11(*a*) is a bottom view of the same flooring block A, FIG. 11(*b*) is a front view of a lock pin, and FIG. 11(*c*) is a side view of the same lock pin.
Figure 11C:
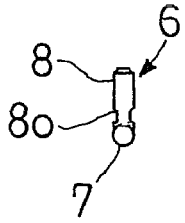
Figure 11B:
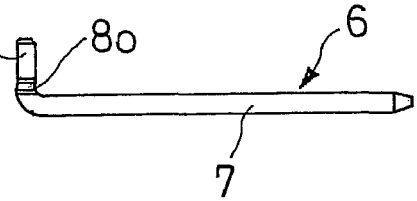
Figures 12A, 12B, 12C:
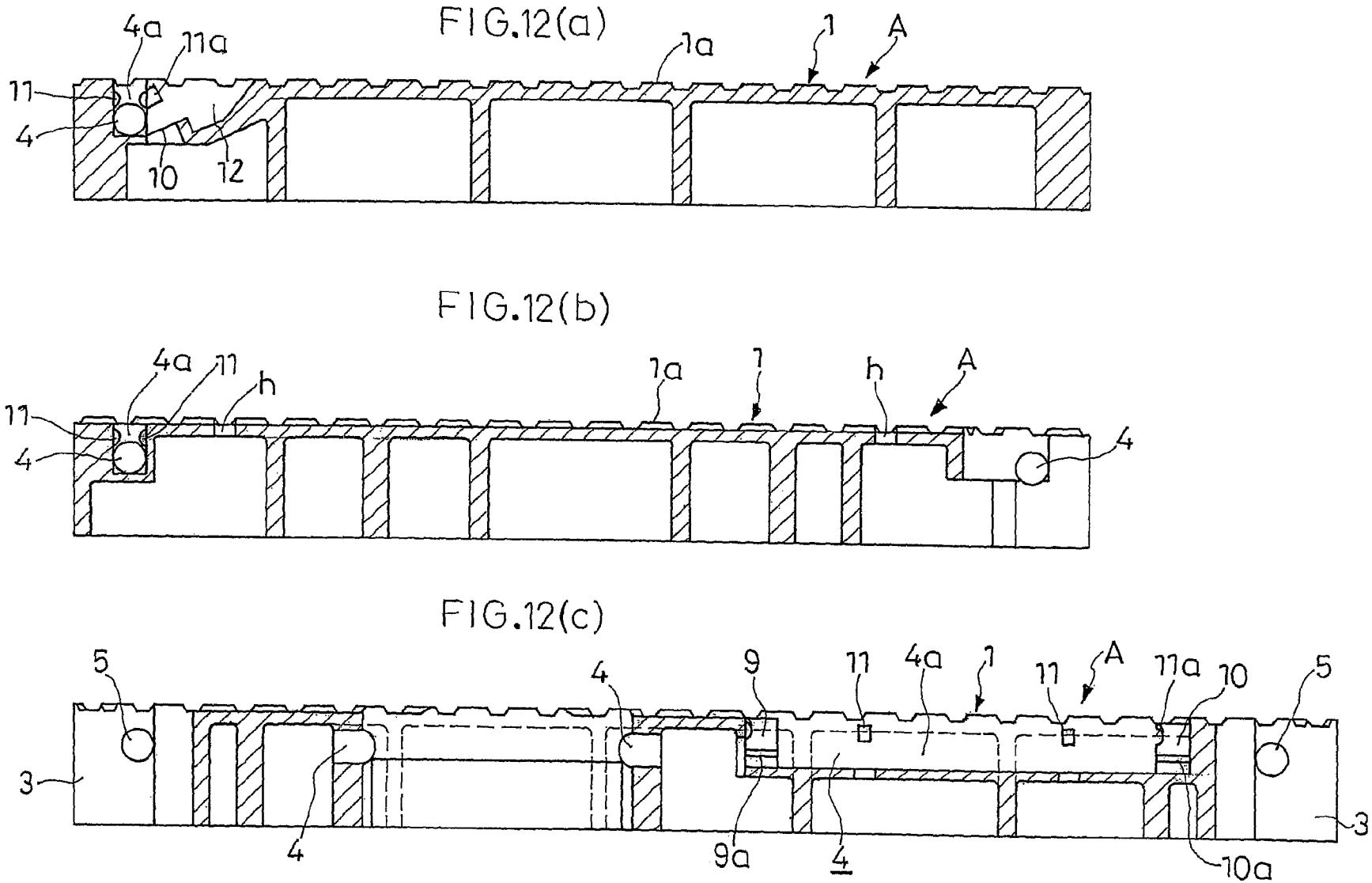
FIG. 12(*a*) is an enlarged sectional view along the X1-X1 line of FIG. 10(*a*), FIG. 12(*b*) is an enlarged sectional view along the X2-X2 line of FIG. 10(*a*), and FIG. 12(*c*) is an enlarged sectional view along the Y1-Y1 line of FIG. 10(*a*)

FIG. 10 through FIG. 15 show another embodiment of the invention, and among these, FIG. 10(*a*) is a plan view of a flooring block relating to the present invention, FIG. 10(*b*) is a side view of the same flooring block from the arrow P of FIG. 10(*a*), FIG. 10(*c*) is a side view from the arrow Q of FIG. 10(*a*), FIG. 11(*a*) is a bottom view of the same flooring block A, FIG. 11(*b*) is a front view of a lock pin, and FIG. 11(*c*) is a side view of the same lock pin. FIG. 12(*a*) is an enlarged sectional view along the X1-X1 line of FIG. 10(*a*), FIG. 12(*b*) is an enlarged sectional view along the X2-X2 line of FIG. 10(*a*), FIG. 12(*c*) is an enlarged sectional view along the Y1-Y1 line of FIG. 10(*a*), FIG. 13(*a*) is an enlarged view of a portion indicated by the arrow V of FIG. 10(*a*), FIG. 13(*b*) is an enlarged sectional view along the Y2-Y2 line of FIG. 13(*a*), FIG. 13(*c*) is an enlarged sectional view along the X3-X3 line of FIG. 13(*a*), FIG. 14(*a*) is an enlarged sectional view along the X4-X4 line of FIG. 13(*a*), FIG. 14(*b*) is an enlarged sectional view along the X5-X5 line of FIG. 13(*a*), and FIG. 14(*c*) is an enlarged sectional view along the X6-X6 line of FIG. 13(*a*).

This flooring block A is formed of a plastic block main body 1 in a square shape having equal side lengths in a plan view as in the case of the above-described embodiment, and as shown in FIG. 10 and FIG. 11, on the four peripheral sides of this square block main body 1, concave portions 2 and convex portions 3 which make concave-convex engagement with each other are alternately formed, and referring to FIG. 10(*a*), on the left half of the upper side of the block main body 1, a convex portion 3 is formed, on the right half of the lower side, a convex portion 3 is formed, on the lower half of the right side of the left and right sides, a concave portion 2 is formed, and on the upper half of the left side, a concave portion 2 is formed. Only a part of the surface 1*a* of the block main body 1 is indicated by the arrow S of FIG. 10(*a*), and as shown in FIG. 10(*b*) and FIG. 10(*c*), the surface 1*a* is subjected to antiskid treatment so as to have irregularity, and on the back surface side, ribs r are formed in a longitudinal, lateral, and diagonal grid pattern. In the entire block main body 1, drain holes h are formed. Thus, by providing drain holes h in the entire region of the block main body 1, rainwater is prevented from stagnating on the surface of the block main body 1, and is drained through the drain hole h, so that the shoes, etc., of users are prevented from getting dirty.

In the block main body 1, along sides on which the concave portions 2 are formed (in FIG. 10(*a*) and FIG. 11(*a*), the right side and the left side), block main body side pin insertion paths 4 are perforated in parallel across the concave portions 2 so as to extend on the entire sides, and in each convex portion 3, as shown in FIG. 3(*a*), a convex portion side pin insertion path 5 which communicates coaxially with the block main body side pin insertion path 4 in a state that the convex portion 3 engages with the concave portion 2 of another block main body 1 is perforated in a direction orthogonal to the block main body side pin insertion path 4.

In the block main body side pin insertion path 4, a pin main body 7 of a lock pin 6 formed in an L shape as shown in FIG. 11(*b*) including the pin main body 7 and a handle portion 8 projecting sideways perpendicularly from one end of the pin main body 7 is inserted rotatably and slidably between a joining position across the concave portion 2 as shown in the left side of FIG. 10(*a*) and a housed position withdrawn from the concave portion 2 as shown in the right side of FIG. 10(*a*). On both side surfaces of the root portion of the handle portion 8 of the lock pin 6, recessed grooves 8*o* are formed so that the pin main body 7 can pass while avoiding protrusions which hold the pin main body 7 so as to prevent it from getting out of the open groove 4*a* when the pin main body 7 is at the housed position as described later are formed (see FIG. 11(*b*) and FIG. 11(*c*)).

The most part of the block main body side pin insertion path 4 is formed into an open groove 4*a* opened to the surface 1*a* of the block main body 1 as seen in FIG. 10(*a*), and from this open groove 4*a*, a first lateral groove 9 in which the handle portion 8 is sunk when the pin main body 7 is at the joining position, and a second lateral groove 10 in which the handle portion 8 is sunk when the pin main body 7 is at the housed position are branched orthogonally to the open groove 4*a*.

On the inner wall faces of the open groove 4*a*, protrusions 11 for holding the lock pin 6 so as to prevent the pin main body 7 at the housed position at the time of transportation, etc., of the flooring block A from coming out of the open groove 4*a* and the lock pin 6 entirely falls out are provided at two positions inside the open groove 4*a*. As seen in the enlarged sectional view of FIG. 14(*a*), these protrusions 11 protrude oppositely to each other in arc sectional shapes from the inner wall faces opposing each other of the open grooves 4*a*, and hold the pin main body 7 of the lock pin 6 within the open groove 4*a*. In this embodiment, a pair of protrusions 11 and 11 on both sides protrude oppositely to each other from the opposite inner wall faces, however, it is also allowed that a protrusion is provided so as to protrude from only one inner wall face. On the inner wall faces of the first lateral groove 9 and the second lateral groove 10, protrusions 11*a* for holding the handle portion 8 of the lock pin 6 in a state that it is sunk in the lateral grooves 9 and 10 when the lock pin 6 is at the housed position are provided in a protruding state.

Figure 13A:
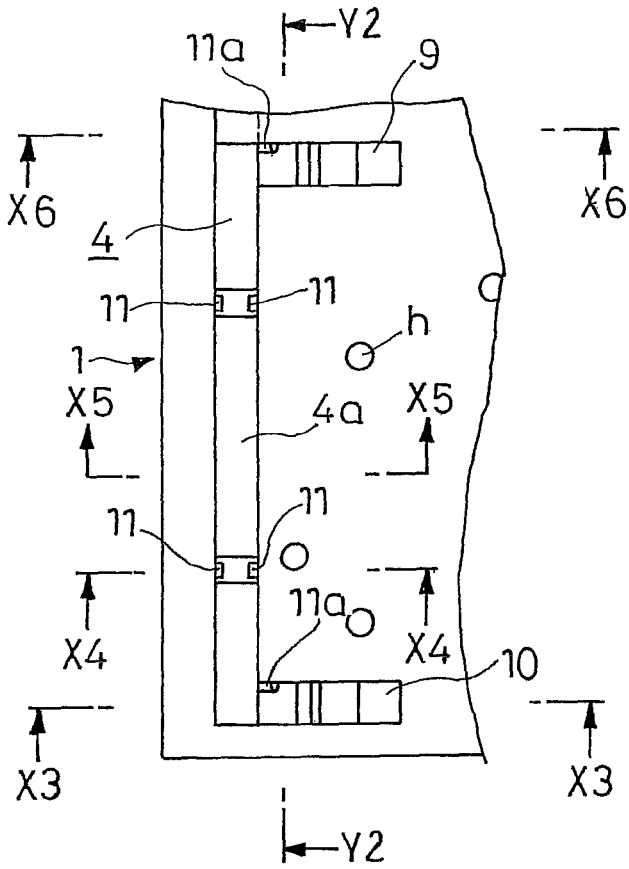
FIG. 13(*a*) is an enlarged view of a portion indicated by the arrow V of FIG. 10(*a*), FIG. 13(*b*) is an enlarged sectional view along the Y2-Y2 line of FIG. 13(*a*), and FIG. 13(*c*) is an enlarged sectional view along the X3-X3 line of FIG. 5(*a*)
Figure 13B:
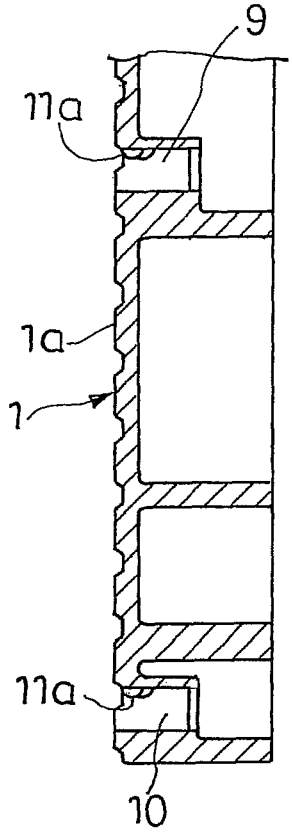
Figure 13C:
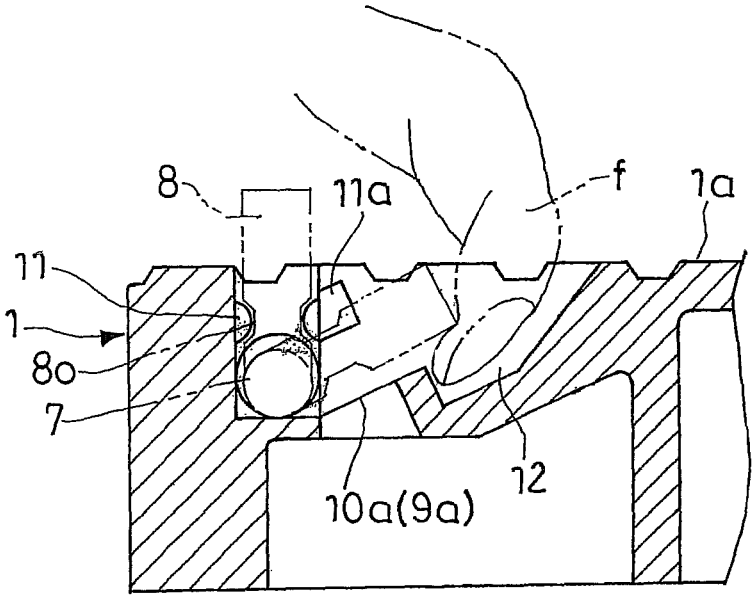
Figure 14C:
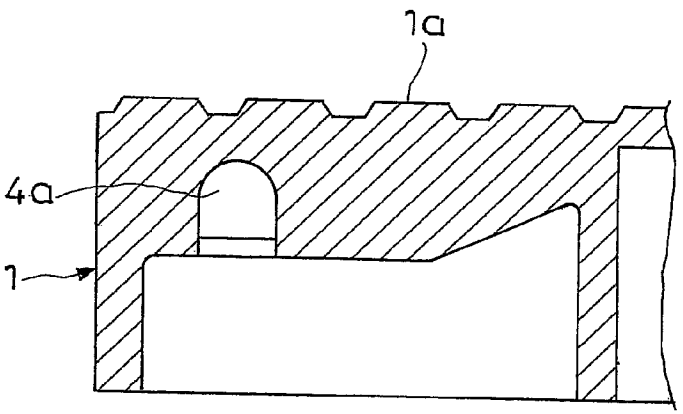
FIG. 14(*a*) is an enlarged sectional view along the X4-X4 line of FIG. 13(*a*), FIG. 14(*b*) is an enlarged sectional view along the X5-X5 line of FIG. 13(*a*), and FIG. 14(*c*) is an enlarged sectional view along the X6-X6 line of FIG. 13(*a*)
Figure 14A:
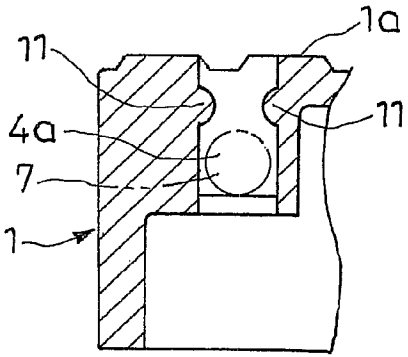
Figure 14B:
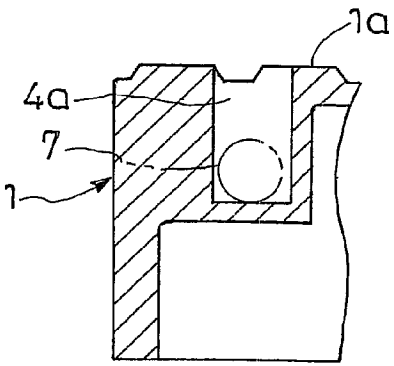

The first lateral groove 9 and the second lateral groove 10 have, as seen in FIG. 10(*b*), FIG. 12(*a*), and FIG. 13(*c*), bottom surfaces 9*a* and 10*a* formed into inclined surfaces upslope toward the surface 1*a* of the block main body 1 from the bottom of the open groove 4*a*, and therefore, when pulling-up the handle portion 8 of the lock pin 6 sunk in each lateral groove 9 or 10, by inserting an operator's finger f or a screwdriver into the upstream side end of the inclined bottom surface 9*a* or 10*a* of the lateral groove 9 or 10, the handle portion 8 of the lock pin 6 can be easily pulled up. The inclination angle of the inclined bottom surfaces 9*a* and 10*a* with respect to the horizontal plane is preferably about 25 to 45 degrees.

In this case, the upstream end sides of the inclined bottom surfaces 9*a* and 10*a* of the first lateral groove 9 and the second lateral groove 10 are engraved one step deeper to form insertion portions 12 into which an operator's finger f or rod-like body is inserted, whereby the tip end of the handle portion 9 of the lock pin 6 sunk in each lateral groove 9 or 10 can be easily caught by the finger f or the rod-like body can be easily hooked on the tip end of the handle portion 8, so that it becomes easier to pull-up the handle portion 8.

Figure 15B:
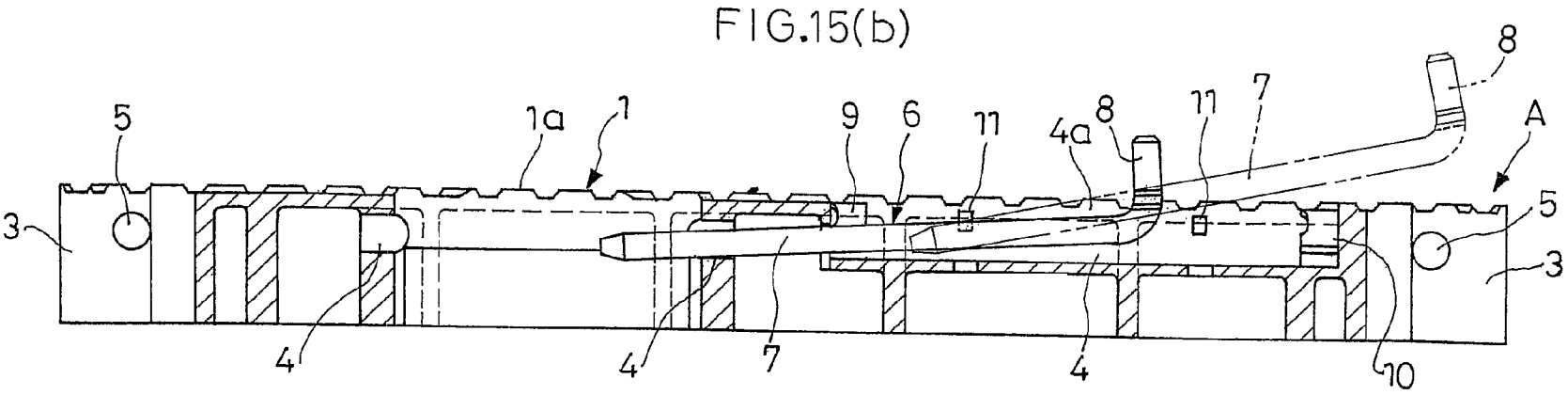
FIG. 15(*a*) is a sectional view of a state that a lock pin is inserted in a block main body side pin insertion path of the flooring block A, and FIG. 15(*b*) is a sectional view describing a method for inserting the lock pin into the block main body side pin insertion path of the flooring block A.
Figure 15A:
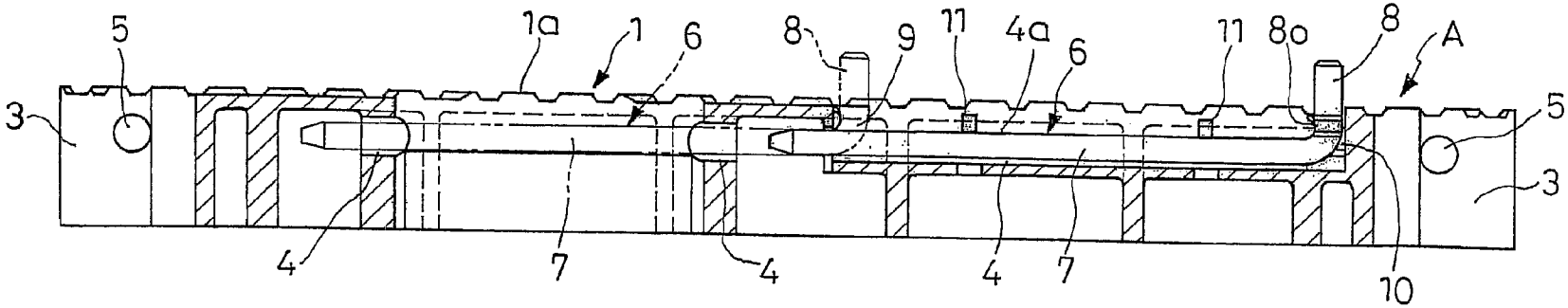

The above-described method for joining the concave portion 2 and the convex portion 3 which engage with each other will be described with reference to FIG. 10. In the state that the pin main body 7 of the lock pin 6 is withdrawn to the housed position, the concave portion 2 and the convex portion 3 facing each other of the block main bodies 1 and 1 of the flooring blocks A and A adjacent front and rear or left and right are engaged with each other, and then the handle portion 8 of the lock pin 6 sunk in the second lateral groove 10 is pulled up and made to move out of the second lateral groove 10, and thereafter, as shown in FIG. 15(*a*), the pulled-up handle portion 8 is gripped and the pin main body 7 is slid from the housed position to the joining position along the open groove 4*a* of the block main body side pin insertion path 4, whereby the concave portion 2 and the convex portion 3 are joined to each other. After this joining, the handle portion 8 of the lock pin 6 is pushed and sunk into the first lateral groove 9, whereby the lock pin 6 can be locked at the joining position.

In this case, the handle portion 8 of the lock pin 6 is provided with the recessed grooves 8*o* which make the handle portion pass through the open groove 4*a* while avoiding the protrusions 11 protruding from the inner wall faces of the open groove 4*a*, so that when sliding the pin main body 7 along the block main body side pin insertion path 4, the handle portion 8 is prevented from being caught by the protrusions 11 inside the open groove 4*a*, and the handle portion 8 can be smoothly passed through while avoiding the protrusions 11 on the open groove 4*a* side. By forming the handle portion 8 of the lock pin 6 to be appropriately smaller in diameter than the pin main body 7, it is not necessary to provide the recessed grooves 8*o* on the handle portion 8, however, in this case, the manufacturing cost of the lock pin 6 becomes high. That is, the lock pin 6 can be easily manufactured by forming the pin main body 7 and the handle portion 8 by bending a metal rod member into an L shape, so that in this case, the recessed grooves 8*o* are formed on the handle portion 8.

After laying a number of flooring blocks A on a predetermined location as described above, if a part of the flooring blocks A is broken and needs replacement, the handle portions 8 of the lock pins 6 attached to the flooring block A that need replacement are pulled up from the first lateral grooves 9 and the pin main bodies 7 are slid by the handle portions 8 from the joining positions to the housed positions, whereby this flooring block A can be separated from other flooring blocks A adjacent to the flooring block A in question, so that only the flooring block A that was broken and needs replacement can be removed and replaced with a new one.

According to this flooring block A, the protrusions 11 are provided in a protruding state from the inner wall faces of the open groove 4*a* of the block main body side pin insertion path 4 so as to prevent the pin main body 7 of the lock pin 6 from coming out of the open groove 4*a* when it is at the housed position, so that when transporting the flooring block A from a storage location to a laying site, there is no possibility that the pin main body 7 at the housed position comes out of the open groove 4*a* and the lock pin 6 falls out the block main body 1.

FIG. 15(*b*) describes a method for inserting the lock pin 6 into the block main body side pin insertion path 4 of the flooring block A, and to insert the lock pin 6 into the block main body side pin insertion path 4, the pin main body 7 is inserted into the open groove 4*a* from the middle position between the protrusions 11 and 11 at two points inside the open groove 4*a* in an inclined posture in that the tip end side lowers as shown by the imaginary lines in FIG. 15(*b*), and the tip end of the pin main body 7 is pushed into the block main body side pin insertion path 4 while being pushed-up by hand from the lower surface side of the block main body 1. In this case, when the lock pin 6 is in the state illustrated by the solid lines in FIG. 15(*b*), the tip end side of the pin main body 7 is in strong pressure-contact with the hole wall faces of the block main body side pin insertion path 4, so that it becomes easier to insert it by hammering the handle portion 8 with an appropriate tool. To extract the lock pin 6 from the block main body side pin insertion path 4, it is pulled up diagonally as illustrated by the imaginary lines from the state illustrated by the solid line in FIG. 15(*b*) in the reverse order of the insertion.

To sink the handle portion 8 of the lock pin 6 in the first lateral groove 9 or the second lateral groove 10, by strongly pushing the handle portion 8 into the first lateral groove 9 or the second lateral groove 10, the protrusions 11*a* elastically deform and the handle portion 8 can be easily sunk in the first lateral groove 9 or the second lateral groove 10.

To continuously lay the flooring blocks A forward, rearward, leftward, and rightward, the concave portion 2 and the convex portion 3 of the block main bodies 1 and 1 of the flooring blocks A and A adjacent in the front and rear direction are engaged with each other, the handle portion 8 of the lock pin 6 is pulled up from the second lateral groove 10, and by this handle portion 8, the pin main body 7 is slid from the housed position to the joining position, whereby the concave portion 2 and the convex portion 3 engaged with each other are joined to each other, and in the same manner, the concave portion 2 and the convex portion 3 of the block main bodies 1 and 1 of the flooring blocks A and A adjacent to each other in the left and right direction are also engaged with each other, and by sliding the pin main body 7 of the lock pin 6 from the housed position to the joining position, the concave portion 2 and the convex portion 3 engaged with each other are joined to each other. Therefore, the flooring blocks A can be easily joined to each other, and the handle portion 8 of the lock pin 6 is sunk in the first lateral groove 9 and does not project from the surface of the block main body 1*a* after joining.

After laying the flooring blocks A, when a part of the flooring blocks A is broken and needs replacement, the handle portions 8 of the lock pins 6 attached to the flooring block A that need replacement are pulled up from the first lateral grooves 9, and by sliding the pin main bodies 7 by the handle portions 8 from the joining positions to the housed positions, this flooring block A can be separated from other adjacent flooring blocks A, so that only the flooring block A that need replacement can be easily removed and replaced with a new one. These flooring blocks A are simple in structure, so that their manufacturing cost is low.

In the flooring block A, on the inner wall faces of the first lateral groove 9 and the second lateral groove 10, insertion portions 10A into which an operator's finger or a rod-like body is inserted to pull-up the handle portion 8 of the lock pin 6 sunk in the lateral grooves 9 and 10 are recessed.

In the first lateral groove 9 and the second lateral groove 10, insertion portions 10A into which an operator's finger or a rod-like body is inserted to pull-up the handle portion 8 of the lock pin 6 sunk in the lateral grooves 9 and 10 are recessed, so that by inserting an operator's finger f or a rod-like body such as a screwdriver into the insertion portion 11, the handle portion 8 can be easily pulled up.

In the flooring block A, as shown in FIG. 5, the bottom surfaces of the first lateral groove 9 and the second lateral groove 10 are formed into inclined surfaces 9*a* and 10*a* upslope toward the block main body surface 1*a* from the bottom of the open groove 4.

The bottom surfaces of the first lateral groove 9 and the second lateral groove 10 are formed into inclined surfaces 9*a* and 10*a* upslope toward the block main body surface 1*a* from the bottom of the open groove 4, so that when the handle portion 8 of the lock pin 6 sunk in each lateral groove 9 or 10 is pulled up, by inserting an operator's finger f or a rod-like body such as a screwdriver into the upstream end side of the inclined bottom surface of the lateral groove 9 or 10, the handle portion 8 can be easily pulled up.

In the flooring block A, the upstream end sides of the inclined bottom surfaces 9*a* and 10*a* of the first lateral groove 9 and the second lateral groove 10 are formed one step deeper to form insertion portions 12 into which an operator's finger or a rod-like body is inserted.

As shown in FIG. 6, the upstream end sides of the inclined bottom surfaces 9*a* and 10*a* of the first lateral groove 9 and the second lateral groove 10 are formed one step deeper to form insertion portions 12 into which an operator's finger or a rod-like body is inserted, so that the handle portion 8 is more easily pulled-up.

In the flooring block A, the lock pin 6 is formed into an L shape including a pin main body 7 and a handle portion 8 projecting sideways perpendicularly from one end of the pin main body 7.

The lock pin 6 is formed into an L shape including a pin main body 7 and a handle portion 8 projecting sideways perpendicularly from one end of the pin main body 7, so that the lock pin 6 is easily manufactured, and the first lateral groove 9 and the second lateral groove 10 are also easily formed.

A peripheral flooring block B is used by being joined to the flooring block A, wherein a convex portion 3 is formed on one side of a block main body 21 in a square shape, and in this convex portion 3, a pin insertion path 5 which communicates coaxially with the block main body side pin insertion path 4 of the flooring block A in a state that the convex portion 3 is engaged with the concave portion 2 of the flooring block A is perforated.

According to the peripheral flooring block B of the invention, after the convex portion 3 thereof is engaged with a concave portion 2 of one flooring block A positioned on the peripheral portion of the flooring blocks joined structure shown in FIG. 8 as shown by the arrow, by sliding the pin main body 7 of the lock pin 6 from the housed position to the joining position according to completely the same method as in the case of the flooring block A described above, the block main body 21 of the peripheral flooring block B can be joined to the block main body 1 of the flooring block A, so that by using this peripheral flooring block B, the concave and convex portions 2 and 3 of the flooring blocks A are prevented from being exposed to the peripheries of the flooring blocks joined structure, and the external appearance and look are improved.

A peripheral flooring block C is used by being joined to the flooring block A, wherein on one side of a block main body 31 in a square shape, a concave portion 2 is formed, a pin insertion path 4 across the concave portion 2 is perforated parallel to the one side, and into this pin insertion path 4, the pin main body 7 of the lock pin 6 is inserted rotatably and slidably between a joining position across the concave portion 2 and a housed position withdrawn from the concave portion 2, and this pin insertion path 4 is partially formed into an open groove 4*a* opened to the block main body surface 31*a*, and this open groove 4*a* is provided with a first lateral groove 9 in which the pin main body 7 at the joining position is sunk and a second lateral groove 10 in which the handle portion 8 at the housed position is sunk.

According to the peripheral flooring block C of the invention, as indicated by an arrow, in a state that the concave portion 2 is engaged with the convex portion 3 of the flooring block A positioned at the periphery of the flooring blocks joined structure shown in FIG. 8, the pin main body 7 of the lock pin 6 provided in this peripheral flooring block C is slid from the housed position to the joining position, whereby the block main body 31 of the peripheral flooring block C can be joined to the block main body 1 of the flooring block A, and therefore, by using the peripheral flooring block C, the concave and convex portions 2 and 3 of the flooring blocks A are prevented from being exposed to the peripheries of the flooring blocks joined structure, and the external appearance and look are improved.

In the peripheral flooring block B, on the surface 21*a* of the block main body 21, a slope 20 is formed in a region opposite to the convex portion 3.

A sloped peripheral flooring block B' of the invention is as shown in FIG. 9(*a*-1) and FIG. 9(*a*-2), wherein when the flooring blocks joined structure for an event site is formed by laying the peripheral flooring blocks B' on, for example, a baseball field, the peripheral portions of the flooring blocks joined structure have no steps, and the risk of catching shoes on the peripheral portions when people step on this flooring blocks joined structure can be avoided.

In the peripheral flooring block C, on the surface 31*a* of the block main body 31, a slope 20 is formed in a region opposite to the concave portion 2.

A sloped peripheral flooring block C' of the invention is as shown in FIG. 9(*b*-*a*) and FIG. 9(*b*-2), wherein when the flooring blocks joined structure for an event site are formed by laying the peripheral flooring blocks C' on, for example, a baseball field, the peripheral portions of the flooring blocks joined structure have no steps, and the risk of catching shoes on the peripheral portions when people step on this flooring blocks joined structure can be avoided.

In the flooring block or the peripheral flooring block B or C, on the inner wall faces of the open groove 4*a*, protrusions 11 for holding the pin main body 7 at the housed position so as to prevent it from coming out of the open groove 4*a* are provided in a protruding state.

On the inner wall faces of the open groove 4*a*, protrusions 11 for holding the pin main body 7 at the housed position so as to prevent it from coming out of the open groove 4*a* are provided in a protruding state, so that when the flooring block A is transported from a storage location to a laying site, there is no possibility that the pin main body 7 at the housed position comes out of the open groove 4*a* and the lock pin 6 falls out the block main body 1.

In the flooring block A or the peripheral flooring block B or C, on the handle portion 8 of the lock pin 6, recessed grooves 8*o* for avoiding the protrusions 11 protruding from the inner wall faces of the open groove 4*a* when the pin main body 7 is slid along the block main body side pin insertion path 4 are provided.

On the handle portion 8 of the lock pin 6, recessed grooves 8*o* for avoiding the protrusions 11 protruding from the inner wall faces of the open groove 4*a* when the pin main body 7 is slid along the block main body side pin insertion path 4 are provided, so that when the pin main body 7 is slid along the block main body side pin insertion path 7, the handle portion 8 is prevented from being caught by the protrusions 11 inside the open groove 4*a*, and the handle portion 8 can smoothly pass through while avoiding the protrusions 11 on the open groove 4*a* side by the recessed grooves 8*o*.

In the flooring block or the peripheral flooring block B or C, on the inner wall faces of the first lateral groove 9 and the second lateral groove 10, protrusions 11*a* for holding the handle portion 8 of the lock pin 6 in a state that it is sunk in the lateral groove 9 or 10 are provided in a protruding state.

On the inner wall faces of the first lateral groove 9 and the second lateral groove 10, protrusions 11*a* for holding the handle portion 8 of the lock pin 6 in a state that it is sunk in the lateral groove 9 or 10 are provided in a protruding state, so that by sinking the handle portion 8 of the lock pin 6 in the first lateral groove 9 or the second lateral groove 10, the handle portion 8 of the lock pin 6 can be prevented from unexpectedly jumping out in response to vibrations during use of the flooring block A, B, or C.

In the flooring block A or the peripheral flooring block B or C, drain holes h are provided in the entire region of the block main body 1.

By thus providing drain holes h in the entire region of the block main body 1, rainwater is prevented from stagnating on the surface of the block main body 1 and is drained through the drain holes h, so that shoes, etc., of users are not stained by rainwater.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A flooring system, comprising a plurality of flooring blocks, each flooring block having:

a square-shaped block main body with concave portions and convex portions which make concave-convex engagement with adjacent flooring blocks, the concave and convex portion being formed on respective sides of the block main body, block main body side pin insertion paths perforated across the concave portions in the block main body along the sides on which the concave portions are formed, convex portion side pin insertion paths perforated in the convex portions, which communicate coaxially with the block main body side pin insertion paths in a state that the convex portions are engaged with concave portions of adjacent flooring blocks, lock pins including pin main bodies and handle portions projecting sideways, the pin main bodies are inserted rotatably and slidably in the block main body side pin insertion paths, and each lock pin has a joining position wherein the lock pin is disposed across one of the concave portions and has a housed position wherein the lock pin is withdrawn from the one concave portion, each block main body side pin insertion path is partially formed into an open groove opened to a block main body surface, and in this open groove, a first lateral groove is provided in which the handle portion of the pin main body is sunk, when at the joining position, and a second lateral groove is provided in which the handle portion of the pin main body is sunk, when at the housed position, and adjacent flooring blocks type being joinable by sliding the pin main body of the lock pin to the joining position in the state that the concave portion and the convex portion of adjacent flooring blocks are engaged with each other.

2. The flooring system according to claim 1, wherein on inner wall faces of the first lateral groove and the second lateral groove, insertion portions are recessed into which an operator's finger or a rod-like body may be inserted to pull-up the handle portion of the lock pin sunk in the lateral grooves.

3. The flooring system according to claim 1, wherein bottom surfaces of the first lateral groove and the second lateral groove are formed into inclined surfaces upslope toward the block main body surface from the bottom of the open groove.

4. The flooring system according to claim 3, wherein an upstream end sides of the inclined bottom surfaces of the first lateral groove and the second lateral groove are formed one step deeper to form insertion portions into which an operator's finger or a rod-like body is may be inserted.

5. The flooring system according to claim 1, wherein the lock pin is formed into an L shape including a pin main body and a handle portion projecting sideways perpendicularly from one end of the pin main body.

6. The flooring system according to claim 1, further comprising a peripheral flooring block which is used by being joined to an adjacent flooring block, the peripheral flooring block having a convex portion formed on one side of a square-shaped block main body of the peripheral flooring block, and in this convex portion, a pin insertion path is perforated which communicates coaxially with the block main body side pin insertion path of the adjacent flooring block in a state that the convex portion of the peripheral flooring block is engaged with the concave portion of the adjacent flooring block.

7. The flooring system according to claim 1, further comprising a peripheral flooring block which is used by being joined to an adjacent flooring block, the peripheral flooring block having a concave portion formed on one side of a square-shaped block main body of the peripheral flooring block, and having a pin insertion path perforated across the concave portion of the peripheral flooring block parallel to the one side, and into this pin insertion path, the pin main body of the lock pin is inserted rotatably and slidably between a joining position across the concave portion and a housed position withdrawn from the concave portion, and this pin insertion path is partially formed into an open groove opened to a block main body surface of the peripheral flooring block, and this open groove is provided with a first lateral groove in which the pin main body at the joining position is sunk and a second lateral groove in which the handle portion at the housed position is sunk.

8. The flooring system according to claim 6, wherein a slope is formed on the surface of the block main body of the peripheral flooring block, in a region opposite to the convex portion of the peripheral flooring block.

9. The flooring system according to claim 7, wherein a slope is formed on the surface of the block main body of the peripheral flooring block, in a region opposite to the concave portion of the peripheral flooring block.

10. The flooring system of claim 1, wherein protrusions are provided on the inner wall faces of the open groove, for holding the pin main body at the housed position so as to prevent it from coming out of the open groove.

11. The flooring system according to claim 10, wherein recessed grooves are provided on the handle portion of the lock pin, for avoiding the protrusions protruding from the inner wall faces of the open groove when the pin main body is slid along the block main body side pin insertion path are provided.

12. The flooring system of claim 1, wherein protrusions are provided on inner wall faces of the first lateral groove and the second lateral groove, for holding the handle portion of the lock pin in a state that it is sunk in the lateral groove.

13. The flooring system according to claim 1, wherein drain holes are provided in the entire region of the block main body.

* * * * *